US011732454B2

(12) United States Patent
Tran

(10) Patent No.: US 11,732,454 B2
(45) Date of Patent: Aug. 22, 2023

(54) WATER CONTROL SYSTEM FOR A TANKLESS TOILET

(71) Applicant: Fruitland Beauty Inc., Stoney Creek (CA)

(72) Inventor: Huy Tran, Stoney Creek (CA)

(73) Assignee: FRUITLAND BEAUTY INC., Stoney Creek (CA)

( * ) Notice: Subject to any disclaimer, the term of this patent is extended or adjusted under 35 U.S.C. 154(b) by 184 days.

(21) Appl. No.: 17/468,027

(22) Filed: Sep. 7, 2021

(65) Prior Publication Data

US 2023/0069719 A1 Mar. 2, 2023

Related U.S. Application Data

(60) Provisional application No. 63/238,369, filed on Aug. 30, 2021.

(51) Int. Cl.

| | |
|---|---|
| ***E03D 5/02*** | (2006.01) |
| ***E03D 9/00*** | (2006.01) |
| ***E03D 5/01*** | (2006.01) |

(52) U.S. Cl.

CPC ..... *E03D 5/024* (2013.01); *E03D 5/01* (2013.01); *E03D 9/005* (2013.01)

(58) Field of Classification Search

CPC ..... E03D 5/024; E03D 5/01; E03D 9/005; E03D 5/02

See application file for complete search history.

(56) References Cited

U.S. PATENT DOCUMENTS

2004/0068785 A1* 4/2004 Tomita ..... E03D 11/08 4/420.4
2022/0275617 A1* 9/2022 Sun ..... E03D 1/286

FOREIGN PATENT DOCUMENTS

WO WO-2014028970 A1 * 2/2014 ..... E03B 1/042

* cited by examiner

*Primary Examiner* — Christine J Skubinna
(74) *Attorney, Agent, or Firm* — Westman, Champlin & Koehler, P.A.

(57) ABSTRACT

A water control system for a tankless toilet includes a first flush control operating a first control valve, a second control valve, and a first water supply valve. The first control valve is moved by operation of the first flush control. The second control valve and the first water supply valve move by operation of the first control valve. When the first control valve is closed pressurized water is applied to the second control valve and the first water supply valve to maintain them closed. When the first control valve is open the water pressure applied to the second control valve and the first water supply valve is reduced causing them to open. When the first water supply valve is closed pressurized water is prevented from being delivered to a toilet bowl and when open pressurized water is delivered to a bottom jet of the toilet bowl.

17 Claims, 10 Drawing Sheets

WATER CONTROL SYSTEM FOR A TANKLESS TOILET

CROSS REFERENCE TO RELATED APPLICATIONS

This Application claims priority to and the benefit of U.S. Provisional Patent Application No. 63/238,369, filed Aug. 30, 2021, the content of which is incorporated herein by reference in its entirety.

FIELD

This invention relates generally to the field of plumbing fixtures, and in particular to a water control system for a tankless toilet.

BACKGROUND

Tankless toilets have slowly gained in popularity over time, to the point where they are now relatively common in commercial buildings and are becoming more commonly used in residential settings as well. Whereas in a traditional tank-style toilet water is dumped into the bowl at a sufficient rate to activate a siphon which pulls water and waste from the bowl and into a drain, tankless toilets operate in a different fashion. In many cases a tankless toilet will utilize approximately the same amount of water as a tank-style toilet, however, water from a water main water feed enters the bowl at a pressure that is significant enough to permit the bowl to be evacuated. That is, for the most part tankless toilets use only the force of the water entering the bowl as the motive force that clears the bowl.

Since no tank is required, tankless toilets can be advantageous from a space saving perspective. Tankless toilets also can often be more reliable and can enhance the ability for designers to create a sleeker and more modern design. One drawback to current tankless toilets is that they are largely unable to accommodate a small and a large flush function, a feature is becoming more common in tank-style toilets. Further, in many instances tankless toilets utilize relatively complex valve structures, that at times require electricity for their operation. The use of electricity in conjunction with any plumbing fixture introduces an enhanced level of complexity on account of steps that need to be taken to prevent accidental shock or electrocution. Tankless toilets also generally do not provide an ability for a separate injection of a cleaning solution into the bowl of the toilet, which may be desirable in particular applications.

There continues to exist the need for an improved water control system for use in association with a tankless toilet.

SUMMARY

Accordingly, in one aspect, the invention provides a water control system for a tankless toilet, the water control system comprising a first flush control operating a first control valve, a second control valve, and a first water supply valve, each of the first control valve, the second control valve, and the first water supply valve having an open and a closed configuration, the first control valve moved between its open and its closed configuration by operation of the first flush control, the second control valve and the first water supply valve moved between their open and their closed configurations by operation of the first control valve, when the first control valve is in its closed configuration pressurized water from a pressurized source is applied to the second control valve and the first water supply valve maintaining them in their closed configurations, when the first control valve is in its open configuration the pressure of water from the pressurized source applied to the second control valve and the first water supply valve is reduced causing the second control valve and the first water supply valve to move to their open configurations, when the first water supply valve is in its closed configuration pressurized water from the pressurized source is prevented from being delivered to a bowl of the toilet, when in its open configuration the first water supply valve permitting the delivery of pressurized water from the pressurized source to a bottom jet of the toilet bowl.

In a further aspect the invention concerns a water control system for a tankless toilet, the water control system comprising a first flush control, a first control valve, a second control valve, a second flush control operating a third control valve, and a first water supply valve, each of the first control valve, the second control valve, and the first water supply valve having an open and a closed configuration, the first control valve moved between its open and its closed configuration by operation of the first flush control, the second control valve and the first water supply valve moved between their open and their closed configurations by operation of the first control valve, when the first control valve is in its closed configuration pressurized water from a pressurized source is applied to the second control valve and the first water supply valve maintaining them in their closed configurations, when the first control valve is in its open configuration the pressure of water from the pressurized source applied to the second control valve and the first water supply valve is reduced causing the second control valve and the first water supply valve to move to their open configurations, when the first water supply valve is in its closed configuration pressurized water from the pressurized source is prevented from being delivered to a bowl of the toilet, when in its open configuration the first water supply valve permitting the delivery of pressurized water from the pressurized source to a bottom jet of the toilet bowl, wherein the second control valve is operatively associated with a second water supply valve having an open and a closed configuration, the second water supply valve moved between its open and its closed configuration through operation of the second control valve, when in its open configuration the second water supply valve permitting the delivery of pressurized water from the pressurized source to a rim input of the toilet bowl, when in its closed configuration the second water supply valve preventing the delivery of pressured water from the pressurized source to the rim input, wherein the second flush control operates a third control valve having an open and a closed configuration, when in its open configuration the third control valve causing the second water supply valve to move from its closed to its open configuration to permit water from the pressurized source to be delivered to a rim input of the toilet bowl.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DETAILED DESCRIPTION

The present invention may be embodied in a number of different forms. The specification and drawings that follow describe and disclose some of the specific forms of the invention.

Figure 1:
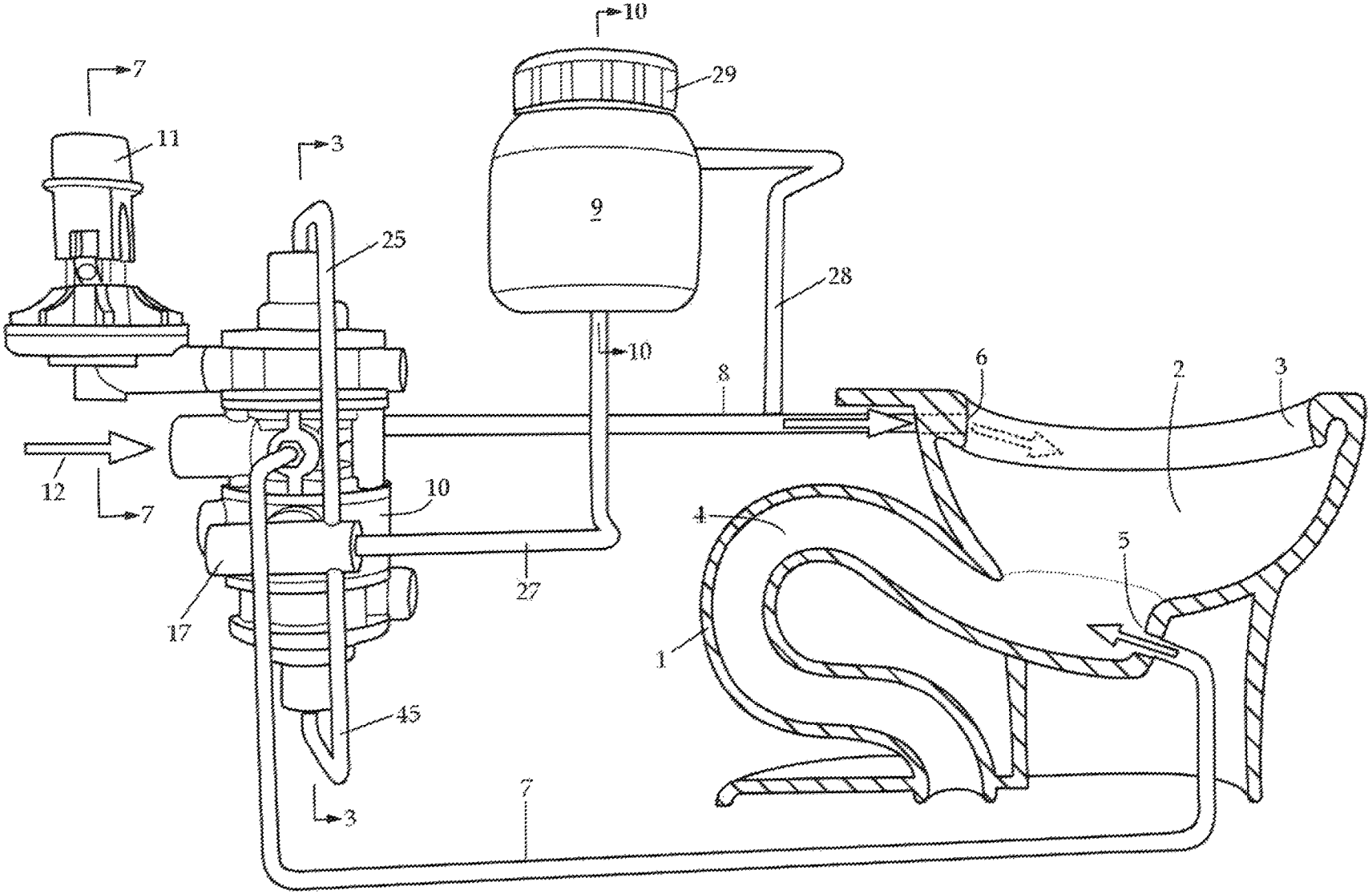
FIG. 1 is a side elevational view of an embodiment of a water control system for a tankless toilet constructed in accordance with the present invention.

FIG. 1 illustrates schematically an embodiment of a water control system for a tankless toilet constructed in accordance with the invention. In FIG. 1 there is shown a generalized toilet 1 that is comprised of a bowl 2, a rim 3, and a gooseneck waste line 4. A bottom jet 5 delivers pressurized water to the toilet bowl to cause a flushing action. A rim input or rim jet 6 delivers pressurized water to the toilet rim, or in some instances may deliver a cleaning or fragrance solution to the rim and into bowl 2. A pressurized water delivery line 7 delivers pressurized water to bottom jet 5, while a pressurized water line 8 delivers water to rim input 6. Also shown in FIG. 1 is a cleaning solution tank 9, a central housing 10, and a first flush control 11, the structure and function of each of which will be described in greater detail below. In the case of FIG. 1, the source of pressurized water for toilet 1 (which in many residential situations will be city or town water) is indicated at 12.

The structure and operation of an embodiment of a water control system for a tankless toilet in accordance with the present invention will now be described in greater detail with reference to the schematic drawing shown in FIG. 2. In broad terms, the control system is comprised of first flush control 11, a first control valve 13, a second control valve 14, and a first water supply valve 15.

In this embodiment first flush control 11 operates first control valve 13 such that activation of first flush control 11 causes first control valve 13 to move from a closed to an open configuration, and wherein a release of a first flush control 11 permits first control valve 13 to return to its closed configuration. In this embodiment, first control valve 13 is normally in a closed configuration.

First control valve 13, second control valve 14 and first water supply valve 15 may be hydraulically closed, spring or biased opening diaphragm valves such that the application of pressure to one side (ie a control side) of the diaphragm maintains the valve in a closed configuration, and wherein the release of such pressure causes the valve to move to an open configuration. The valves may move from their closed to their open configurations when hydraulic pressure on one side of an elastomeric diaphragm 100 is reduced though operation of a spring or through forming the elastomeric diaphragm in a manner that biases the diaphragm toward an open position (as in the case of the attached drawings).

In the case of first water supply valve 15, one operating side of the valve will be connected to the source of pressurized water 12 with the other operating side of the valve connected to line or piping 7 that directs water to bottom jet 5. The control side of first water supply valve 15 is connected to a source of hydraulic control pressure (represented generally by 16). The same source of hydraulic control pressure 16 is also connected to the control side of second control valve 14 such that when line 16 is pressurized both first water supply valve 15 and second control valve 14 are maintained in their closed configuration, whereas a reduction in the pressure in line 16 permits both valves to open.

Figure 2:
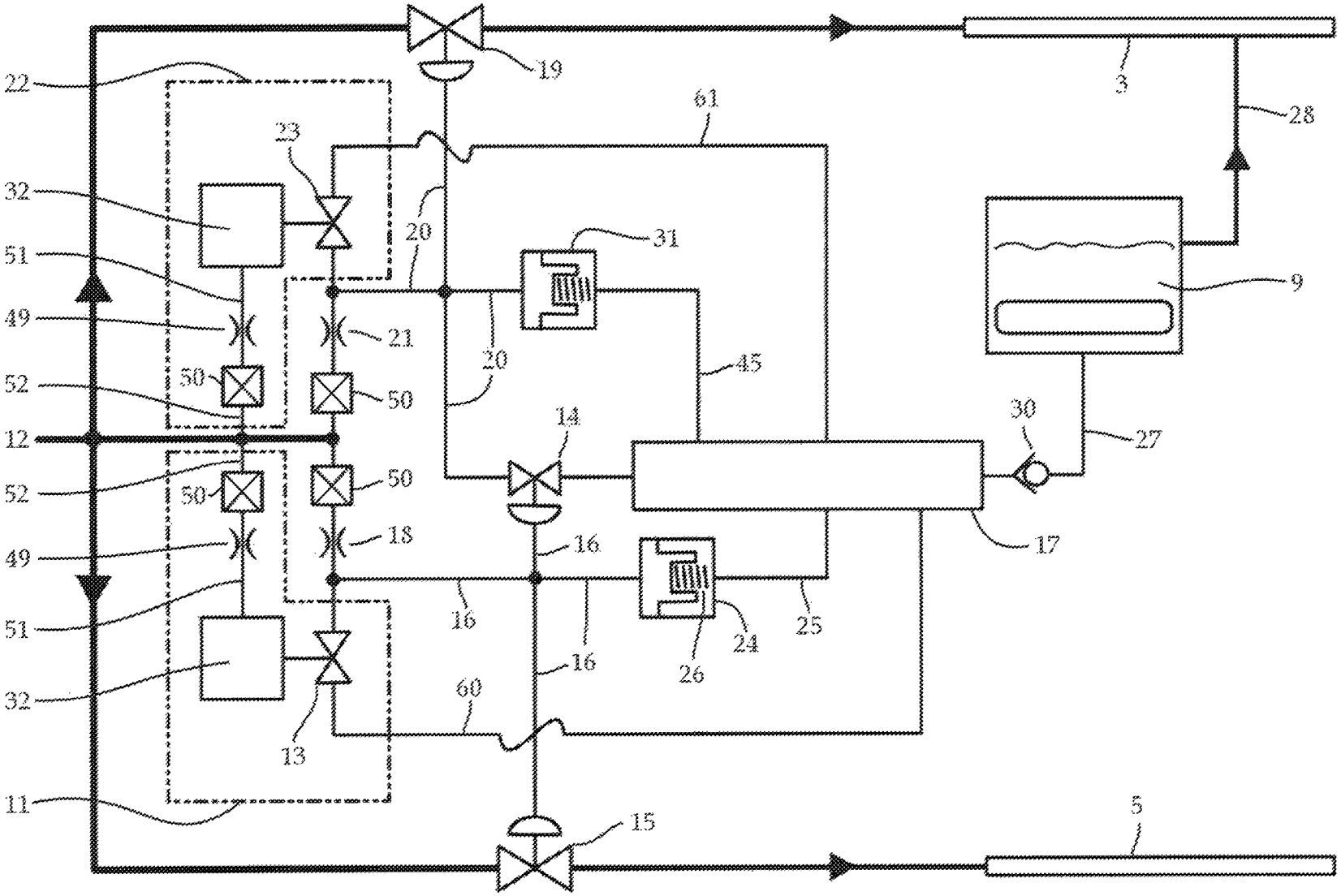
FIG. 2 is a schematic view of a water control system for a tankless toilet in accordance with an embodiment of the invention.
Figure 3:
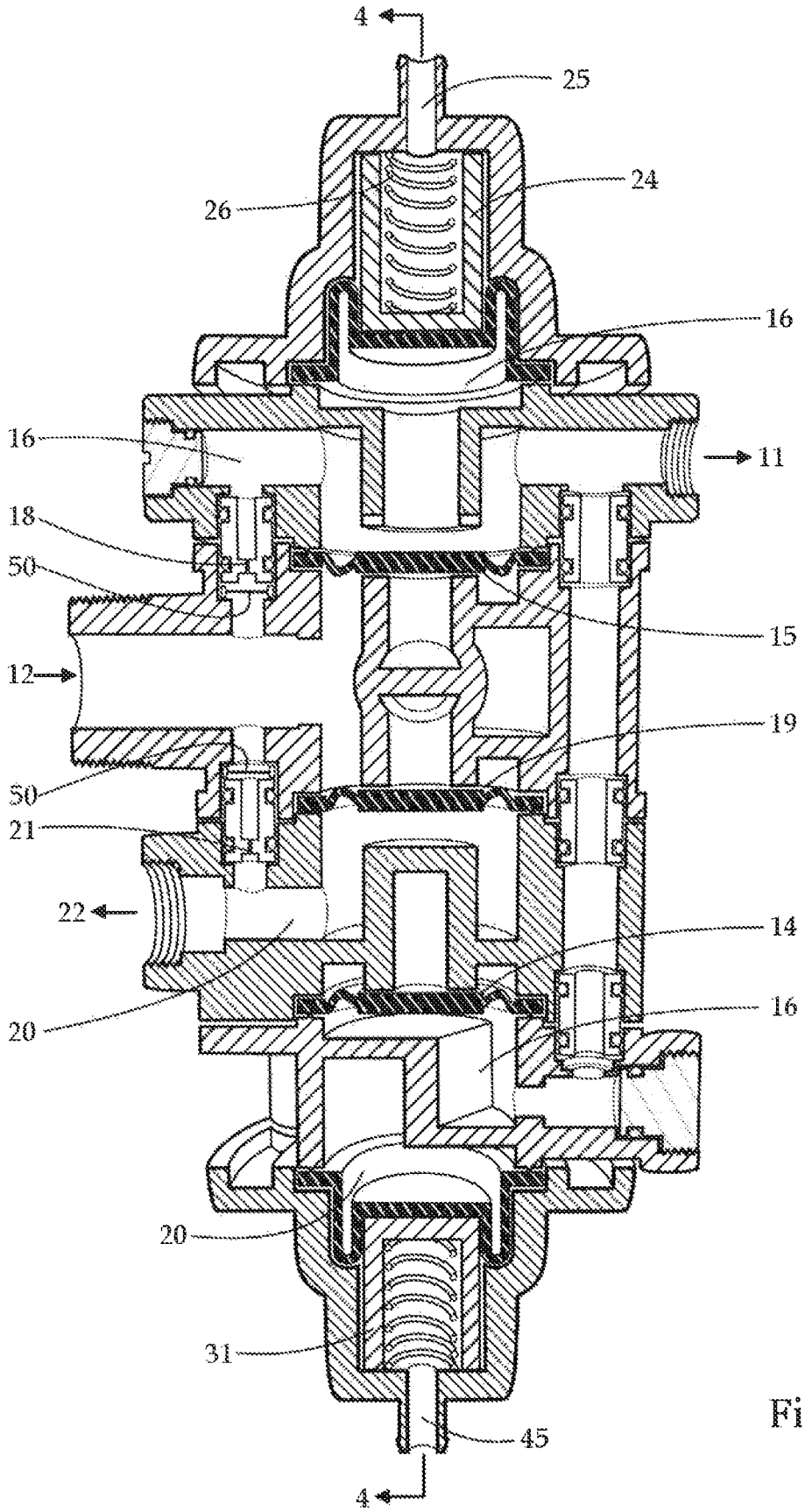
FIG. 3 is a sectional view along the line 3-3 of FIG. 1 through the central housing, and wherein the first and second water supply valves, and the second control valve, are in a closed configuration.
Figure 4:
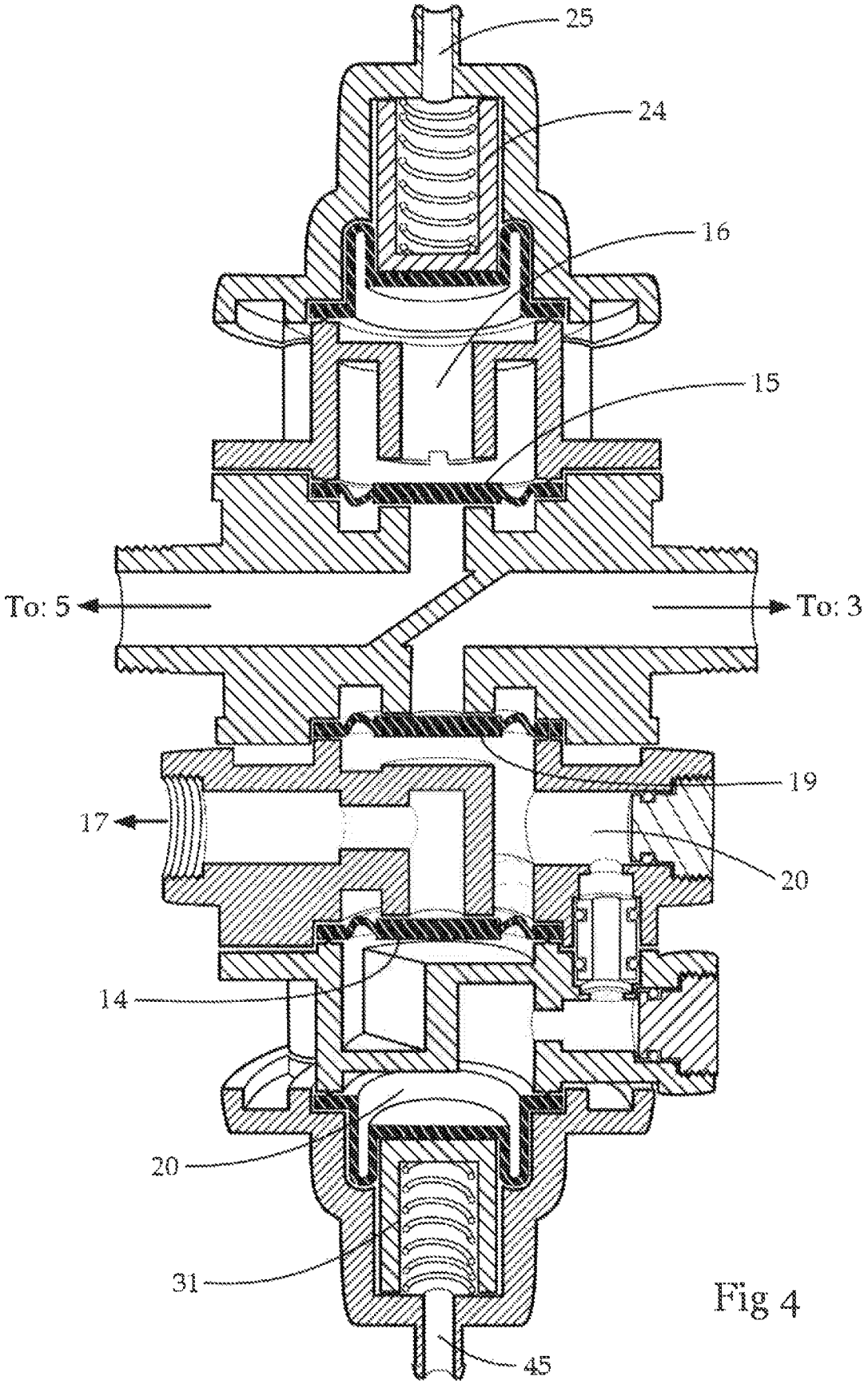
FIG. 4 is a sectional view along the line 4-4 of FIG. 3.
Figure 5:
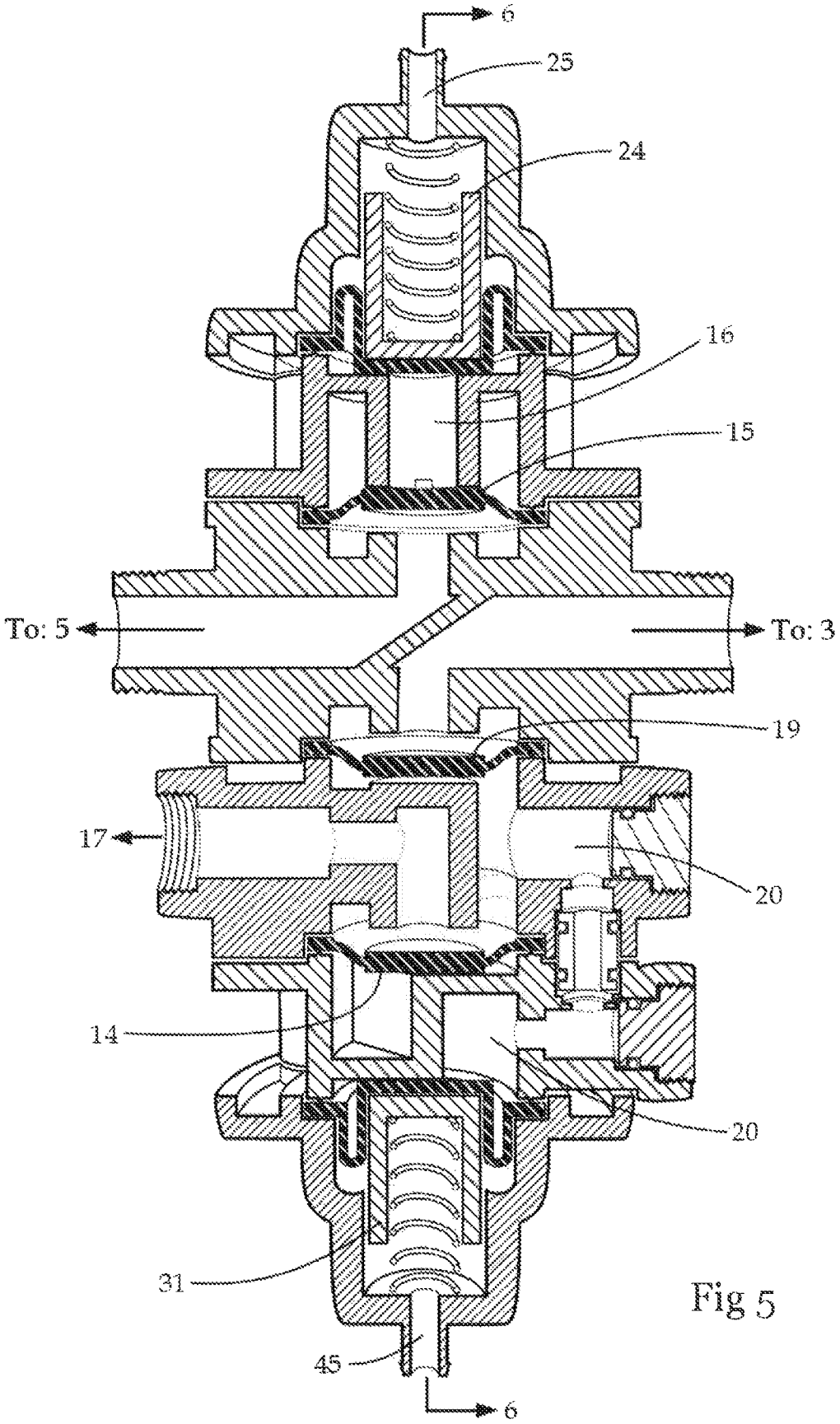
FIG. 5 is a view similar to FIG. 4 wherein the first and second water supply valves, and the second control valve, are in an open configuration.
Figure 6:
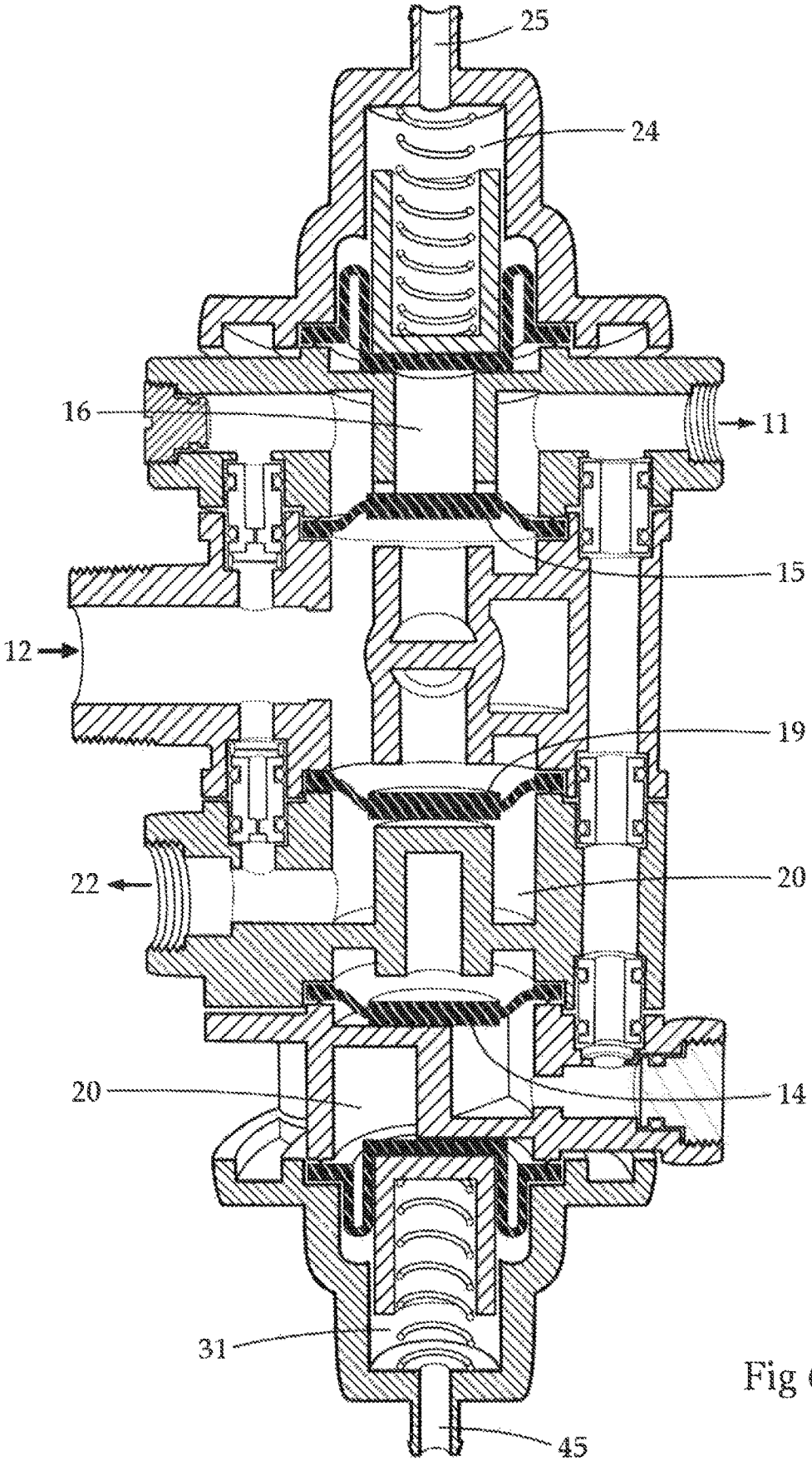
FIG. 6 is a view similar to FIG. 3 wherein the first and the second water supply valves, and the second control valve, are in an open configuration.

As shown schematically in FIG. 2, one side of first control valve 13 is hydraulically connected to line 16 with the other side of first control valve 13 hydraulically connected to a hydraulic manifold 17 by conduit or line 60. Activation of first flush control 11 causes movement of first control valve 13 from its closed to its open position, having the effect of directing pressurized water from line 16 to manifold 17, such that a reduction in the pressure in line 16 causes both second control valve 14 and first water supply valve 15 to move from there closed to their open configurations.

A release of first flush control 11, causes a deactivation or closing of first control valve 13, which blocks the flow of fluid from line 16 through first control valve 13 and into manifold 17. A first orifice 18, hydraulically connected to pressurized water source 12, permits pressurized water to slowly flow from the source of pressurized water into line 16. Thus when first control valve 13 is closed water will flow into line 16 until such time as line 16 is sufficiently pressurized to once again cause second control valve 14 and first water supply valve 15 to move to their closed configurations.

It will be appreciated that the length of time that it will take to re-pressurize line 16 and to close valves 14 and 15 will be a function of a number of different variables, including the pressure of the incoming water, the size of the pipes, conduits or tubing that are utilized, and the relative size of orifice 18. Regardless, it is expected that in most instances a release of first flush control 11 will permit second control valve 14 and first water supply valve 15 to move from their open to their closed configurations in approximately 3 to 5 seconds.

With reference once again to FIG. 2, it will be understood that in an embodiment of the invention second control valve 14 is operatively associated with a second water supply valve 19 that also has an open and a closed configuration. Second water supply valve 19, as in the case of first water supply valve 15, may be a hydraulically closed, spring or biased opening diaphragm valve that has one side connected to source of pressurized water 12. The other side of second water supply valve 19 is hydraulically connected by rim input line 8 to rim input or rim jet 6. Opening the valve thus causes pressurized water to be delivered to the rim of toilet bowl 2.

In a somewhat similar manner as first control valve 13 operates to reduce pressure in line 16 to cause first water supply valve 15 to open, a hydraulic control line 20 links second control valve 14 to second water supply valve 19 such that opening second control valve 14 reduces pressure in line 20 by delivering water in line 20 through valve 14 to hydraulic manifold 17, and causing second water supply valve 19 to open. That is, second water control valve 19 may be effectively operated by a reduction in pressure in line 16, which causes valve 14 to open, causing a drop in the pressure in line 20. Since the pressure within line 16 is effectively controlled by first control valve 13, moving first control valve 13 between is open and close configuration will ultimately open and close both first water supply valve 15 and second water supply valve 19.

For example, when first control valve 13 is opened, pressure in line 16 will be reduced as fluid flows through valve 13 and into hydraulic manifold 17. A reduction in the pressure in line 16 will then cause second control valve 14 to open, thereby bleeding pressure from line 20, through valve 14 and into hydraulic manifold 17. As the pressure in line 20 drops second water supply valve 19 will open, delivering water from source 12 to rim input 6. Essentially simultaneously, a reduction in the pressure in line 16 will open first water supply valve 15, causing the delivery of pressurized water from source 12 to bottom jet 5.

As discussed previously, closing first control valve 13 will have the effect of (over the span of approximately 3 to 5 seconds) allowing pressure in line 16 to rebuild and to thereby close second control valve 14 and first water supply valve 15. In a similar fashion to the control system described for first control valve 13, line 20 is connected to source of pressurized water 12 through a second orifice 21. Once second control valve 14 is closed, pressurized water moving through second orifice 21 will slowly rebuild the pressure within line 20 to a point where second water supply valve 19 will be moved to its closed configuration, thereby stopping the flow of water to rim input 6.

In an embodiment of the invention there may also be provided a second flush control 22 operating a third control valve 23. Second flush control 22 in many instances will essentially be the same as first flush control 11 such that operating second flush control 22 will cause third control valve 23 to open, and a release of second flush control 22 will cause third control valve 23 to close. Third control valve 23 may also be a hydraulically closed, spring or biased opening diaphragm valve as may be valves 13, 14, 15 and 19.

As shown in FIG. 2, one side of third control valve 23 may be hydraulically connected to line 20, with the opposite side of third control valve 23 connected to hydraulic manifold 17, such that opening third control valve 23 causes pressure from line 20 to be bled off into the hydraulic manifold. It will thus be appreciated that in this manner, opening third control valve 23 will have the effect of reducing pressure in line 20 and thereby opening second water supply valve 19 without the operation of either second control valve 14, first flush control 11, or first control valve 13. That is, through the operation of third control valve 23 water can be delivered to rim input 6 without having to deliver water to bottom jet 5. The time that second water supply valve 19 is permitted to be open can be controlled through the sizing of the conduits connecting the control side of the various valves involved and/or through the sizing of second orifice 21. The cycling of second water supply 19 on and off through operation of third control valve 23 can be tailored to deliver a relatively small amount of pressurized fluid to rim of input 6, compared to what would typically be delivered to bottom jet 5. The operation of second flush control 22 may thus be referred to as a "small flush".

In an embodiment, the water control system of the current invention may also include a first diaphragm pump 24 that is operatively associated with first control valve 13. Diaphragm pump 24 has a first and a second diaphragm position. When first control valve 13 is in its closed configuration first diaphragm pump 24 is in its first diaphragm position. When first control valve 13 is moved to its open configuration first diaphragm pump 24 will be moved to its second diaphragm position. One side the diaphragm in first diaphragm pump 24 is connected by line 25 to hydraulic manifold 17. The other side of the diaphragm within diaphragm pump 24 is connected to line 16 such that when line 16 is pressurized diaphragm pump 24 is maintained in its first diaphragm position. A spring biases the diaphragm in first diaphragm pump 24 toward its second diaphragm position. Movement of the diaphragm from its first to its second position will push water from first diaphragm pump 24 into hydraulic manifold 17 through line 60. At the same time water will be drawn from hydraulic manifold 17 through line 25 into the opposite side of diaphragm pump 24.

Figure 10:
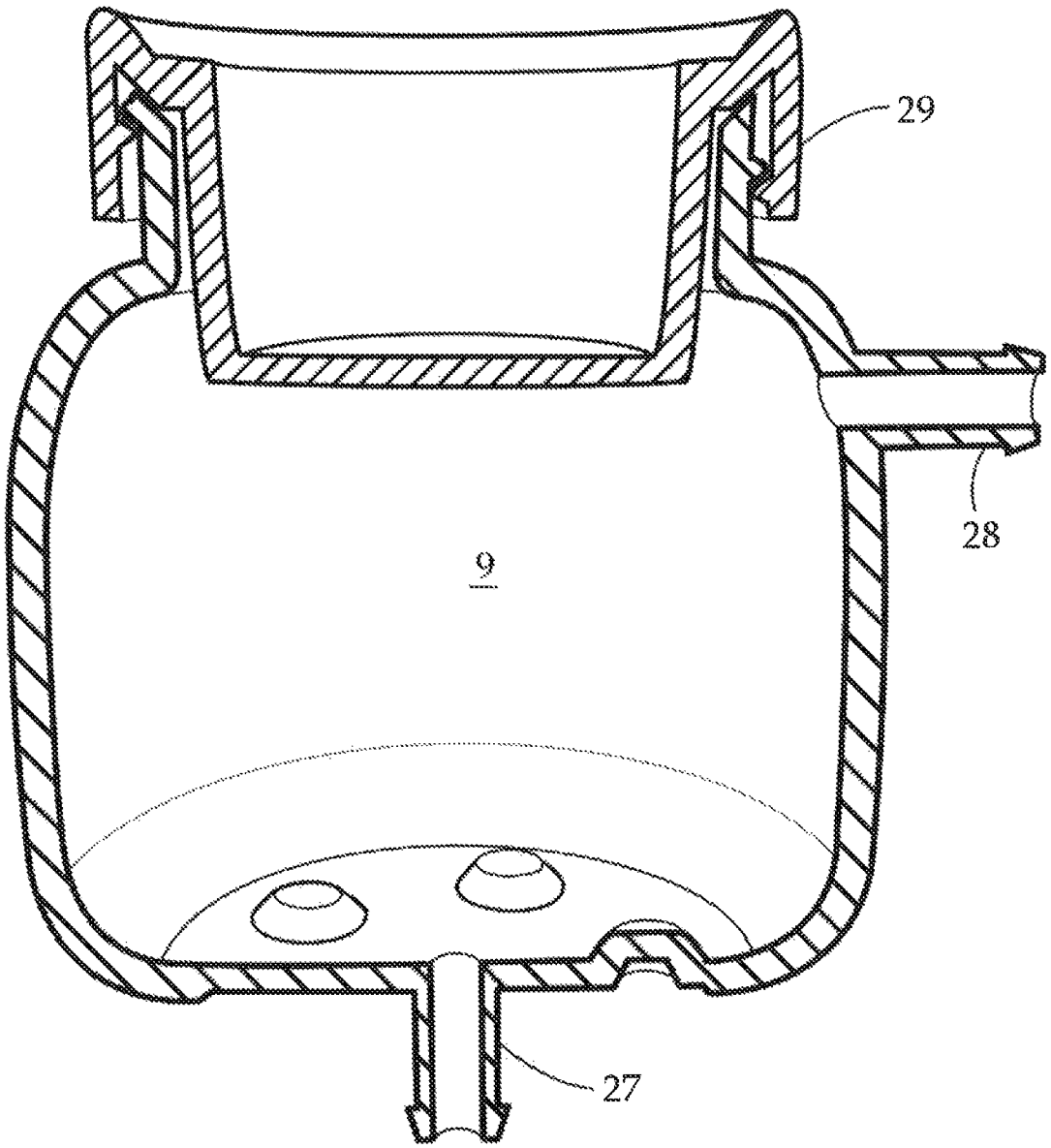
FIG. 10 is a sectional view through the cleaning solution tank and along the line 10-10 of FIG. 1.

In an embodiment, hydraulic manifold 17 is connected through piping or line 27 to cleaning solution tank 9 such that as water is forced into hydraulic manifold 17 through the operation of a first diaphragm pump 24, water is also moved from the hydraulic manifold into cleaning solution tank 9. During operation, cleaning solution tank 9 will typically be sealed and filled to capacity so that movement of water into the cleaning solution tank from the hydraulic manifold will cause a volume of the contents of the tank to be delivered to rim 3 through a hydraulic connection 28. As shown in greater detail in FIG. 10, cleaning solution tank 9 may include a cap 29 that permits cleaning tablets or other types of cleaning or fragrant solutions or materials to be added to the tank, where they can be mixed with water so that an aqueous solution of the cleaning solution and/or fragrance can be delivered to the toilet rim.

From a review of FIG. 2 it will also be noted that movement of the diaphragm of first diaphragm pump 24 from its second diaphragm position back to its first diaphragm position through the building of pressure within line 16 (to overcome the effect of the pump's internal spring) will push water from the other side of the first diaphragm pump 24 into hydraulic manifold 17 through line 25. A check valve 30 in line 27 will prevent water and/or cleaning solution from being drawn into hydraulic manifold 17 from cleaning solution tank 9.

In an embodiment of the invention, the water control system also includes a second diaphragm pump 31 which is operatively associated with both second control valve 14 and third control valve 23. Second diaphragm pump 31 will be largely the same as first diaphragm pump 24, with one side connected to line 20 such that pressure within line 20 in conjunction with spring 26 causes pump 31 to move between a first and a second diaphragm position. In a somewhat similar manner as in the case of first diaphragm pump 24, if either second control valve 14 and/or third control valve 23 are moved to their open configurations such that there is a reduction in the pressure in line 20, spring 26 causes the diaphragm in second diaphragm pump 31 to move from its first to its second diaphragm position, thereby forcing water into hydraulic manifold 17 through line 61. At the same time water will be drawn from hydraulic manifold 17 through line 45 into the opposite side of pump 31. The influx of water into hydraulic manifold 17 will push water into cleaning solution tank 9, and ultimately into rim input 6. A building of pressure within line 20 will thereafter cause the diaphragm in second diaphragm pump 31 to move from its second diaphragm position back to its first diaphragm position. It will be understood that there will be a relatively brief delay in the operation of the first and/or second diaphragm pump following the operation of a corresponding control valve, such that movement of the diaphragm pump between its first and second diaphragm positions will occur shortly after the operation of a corresponding control valve (for example 2 to 3 seconds following the operation of the control valve, or such other time as is desired).

Figure 7:
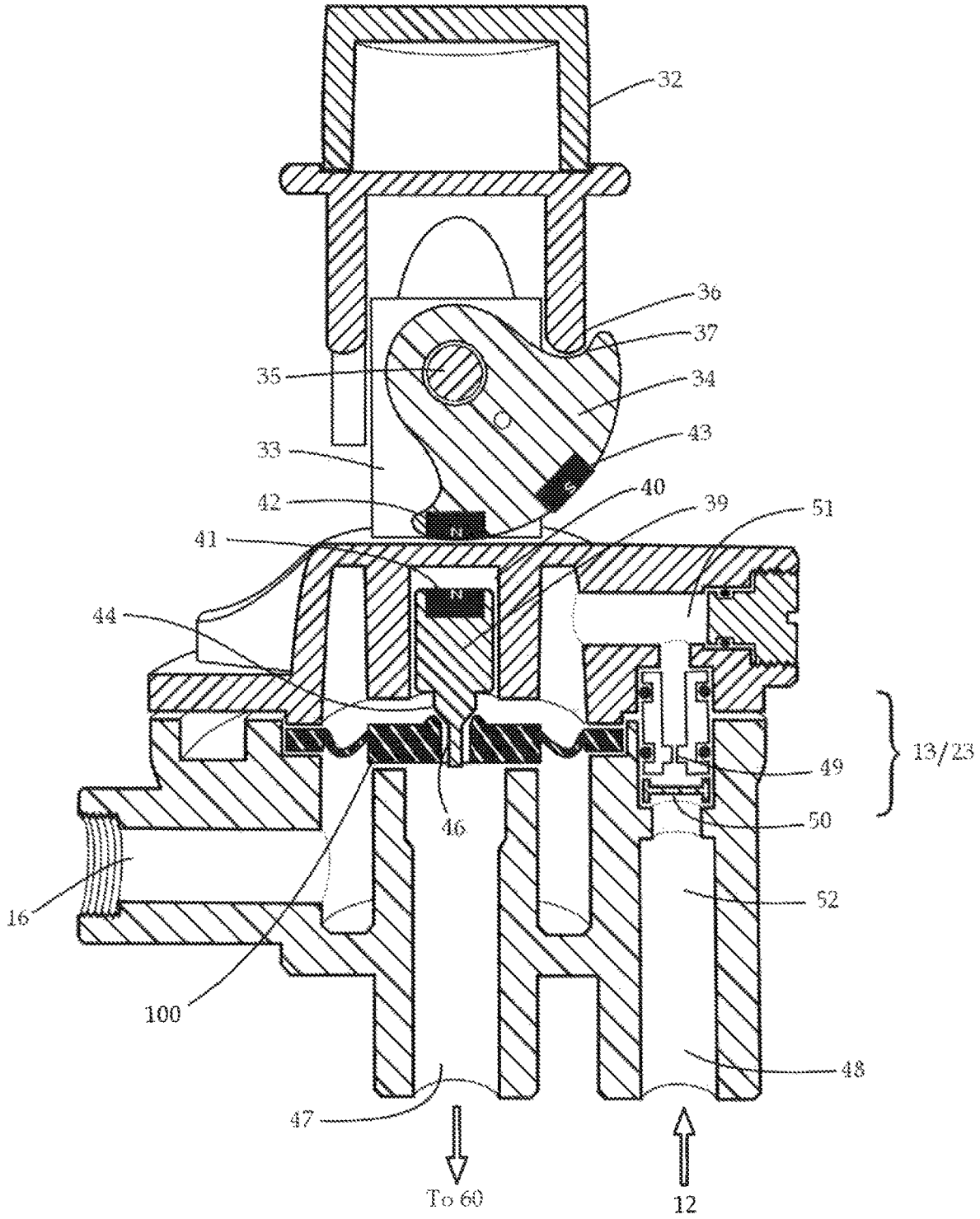
FIG. 7 is a sectional view through the first flush control and along the line 7-7 of FIG. 1 when the first flush control is disengaged.
Figure 8:
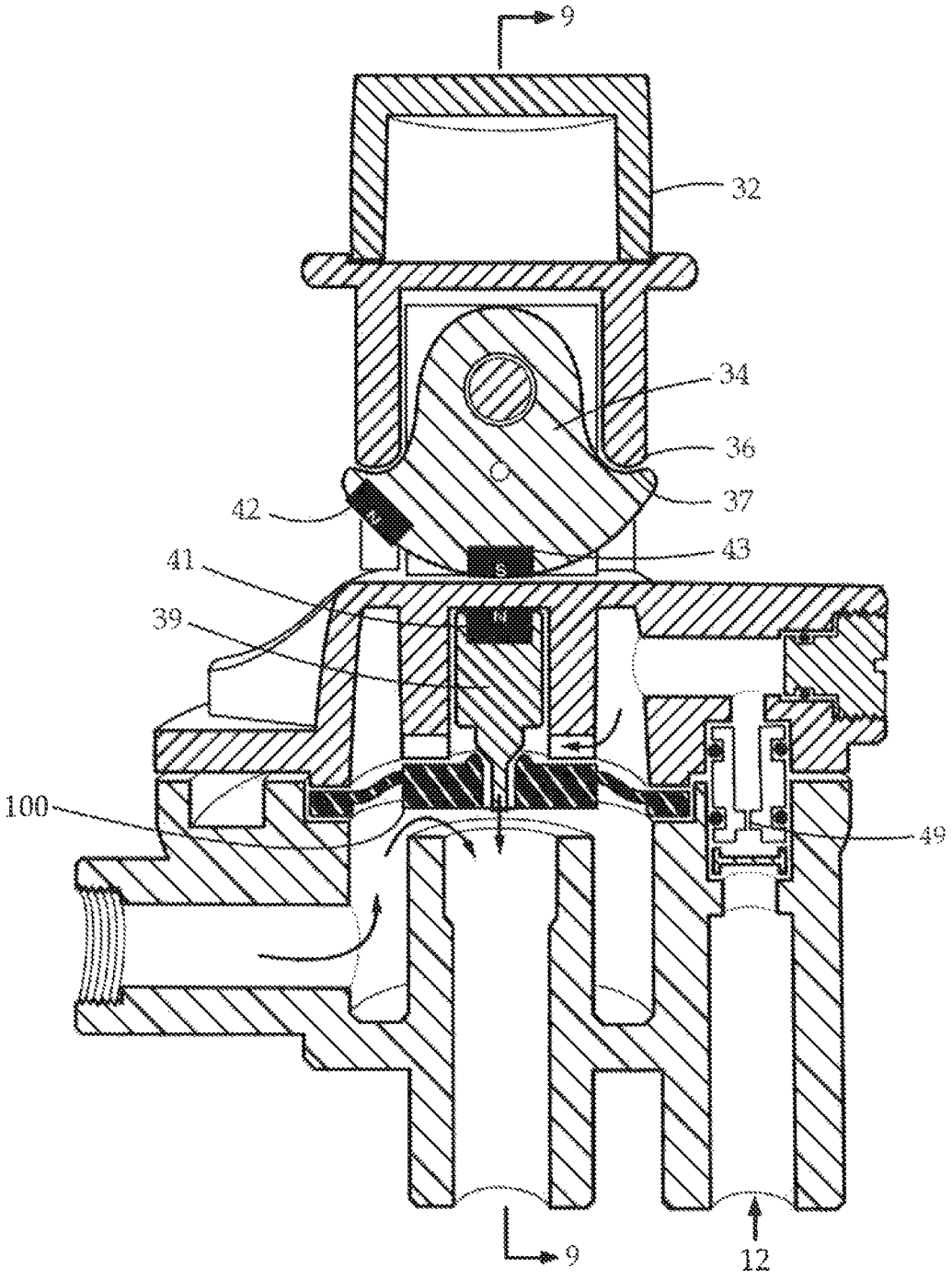
FIG. 8 is a view similar to FIG. 7 wherein the first flush control is engaged.
Figure 9:
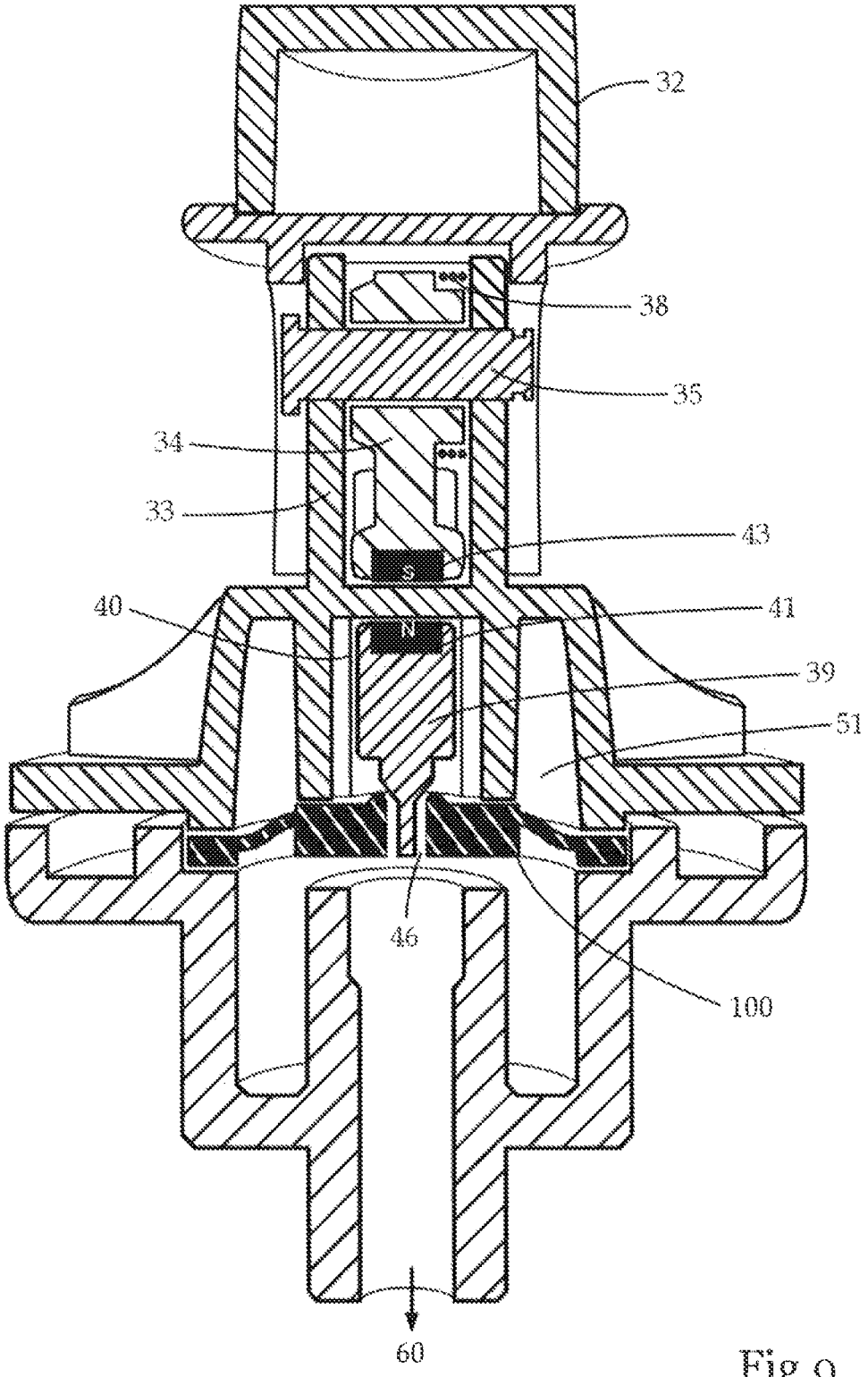
FIG. 9 is a sectional view along the line 9-9 of FIG. 8.

With reference to FIGS. 7 through 9, an embodiment of first flush control 11 and second flush control 22 will now be described. In this embodiment the first and second flush controls are each spring return, magnetic, actuators that provide the mechanism by which first and third control valves 13 and 23 are operated between their open and their closed configurations. The flush controls in this embodiment include a manual push button 32 mounted on a post 33 that is fitted with a rotating or swinging pendulum 34 that rotates or swings about a generally horizontal pin or axle 35.

FIG. 7 shows push button 32 and pendulum 34 in their upper (disengaged) position, as they will exits when they are at rest and push button 32 is not activated or depressed. FIG. 8 shows push button 32 and pendulum 34 in their lower or engaged position, as they will exist when push button 32 is depressed. A spring 38 biases pendulum 34 to its upper position. The engagement of lower arms 36 of push button 32 with mating flanges 37 of pendulum 34 causes a "downward" rotation of pendulum 34 from its upper positon to its lower position when push button 32 is depressed. Similarly, when push button 32 is released, spring 38 causes an "upward" rotation of pendulum 34 such that flange 37 engages arm 36 of push button 32, driving the push button upwardly to its upper or disengaged position.

The flush controls are each further fitted with a plunger 39, which moves upwardly and downwardly (or left and right, depending on the orientation of the plunger) within a bore 40 according to the rotational position of pendulum 34. To accomplish that movement, in an embodiment, plunger 39 is fitted with a magnet 41 and pendulum 34 is fitted with two magnets, 42 and 43 respectively, positioned along an arcuate outer edge. The outwardly extending poles of magnets 41, 42 and 43 are chosen such that when pendulum 34 is in its "up" position (see FIG. 7) magnets 41 and 42 will be generally aligned and will each be of the same pole. For example, FIG. 7 shows magnets 41 and 42 vertically aligned and both being a north pole. In this way, the repulsive force between the respective north poles will cause plunger 39 to be driven in a downwardly manner (or away from push button 32) through bore 40.

Just as the rotation of pendulum 34 "upwardly" causes two like poles of magnets 41 and 42 to be aligned to drive plunger 39 downward or away from push button 32, rotation of pendulum 34 to its "down" positon causes magnets 41 and 43 to be aligned, however, in this instance the poles of the two magnets are opposite resulting in an attractive force being applied to plunger 39. The effect of the attractive force is to cause plunger 39 to be lifted within bore 40 (ie moved toward push button 32) and movement of valve 13 or 23 as the case may be to its open configuration. With reference to FIG. 8, push button 32 is shown in its "down" or depressed position with pendulum 34 rotated until magnet 43 is generally vertically aligned with magnet 41. In this configuration the poles of the two magnets are opposite, thereby forming an attractive force between them lifting plunger 39 within bore 40, or otherwise moving it toward push button 32. This movement of plunger 39 has the effect of opening valve 13 or 23 by permitting an outflow of fluid from line 51 to hydraulic manifold 17, as is discussed in more detail below.

Plunger 39 has a lower end 44 that engages diaphragm 100 of the respective first or third control valve (13 or 23) with which it is associated. In an embodiment, diaphragm 100 of first and third control valves 13 and 23 includes a small opening or orifice 46 through which fluid can pass when plunger 39 is disengaged and not in contact with the diaphragm. When the plunger is not engaged with diaphragm 100, orifice 46 is opened to permit pressurized fluid from line 51 to drain or bleed into port 47 and into line 60 (in the case of first control valve 13) or into line 61 (in the case of third control valve 23) and ultimately into hydraulic manifold 17. The resulting decrease in pressure in line 51 permits diaphragm 100 of valve 13 or 23 to move to its open position. In the case of first control valve 13, fluid from line 16 will then flow into hydraulic manifold 17 and the drop in pressure in line 16 will activate second control valve 14 and first water supply valve 15 (as discussed above). In the case of third control valve 23, fluid from line 20 will low into hydraulic manifold 17 and the resulting drop in pressure in line 20 will activate second control valve 14 and second water supply valve 19 (as also discussed above).

One of ordinary skill in the art will appreciate that the spring return magnetic actuator described above for use in association with flush control 11 may have applications well beyond the present invention. The described actuator could be used in the flow control of liquids for other purposes or for the control of the passage of air or other gases. It may have application in association with other forms of toilet flush controls or may have application in completely different settings and for completely different purposes. It will also be understood that the relative position of the magnetic poles on the components of the actuator could be modified to present a normally open or a normally closed actuator, as the particular application may require. The nature and configuration of plunger 39, and in particular its lower end, could also be modified as required for a particular application or use.

Associated with flush controls (11 and 22) is a port 48 that is connected to the source of pressurized water 12 and that supplies pressurized water to line 51 from line 52. In a similar manner as described above with respect to the supply of pressurized water to lines 16 and 20, an orifice 49 within port 48 permits a relatively slow and controlled delivery of pressurized water into the flush control, in a manner that causes line 51 to be re-pressurized when the respective control valve 13 or 23 moves from an open to a closed configuration. It is expected that in many applications orifice 49 will be dimensioned to cause the re-pressurization of line 51 to a degree that causes first control valve 13 or third control valve 23 (according to the flush control in question) to close in approximately 1 to 2 seconds after the release of push button 32 (it will, however, be appreciated that other lengths of time could be chosen). To help prevent orifice 49 from being plugged with contaminants that may be in the water supply, a filter 50 may be placed upstream of the orifice. Similarly, it may be desirable to place a filter 50 upstream of each of orifices 18 and 21.

It will thus be appreciated that in the case of first flush control 11, depressing push button 32 will have the effect of lifting plunger 39 (or otherwise moving it toward push button 32) and bleeding off pressure from line 51 to the hydraulic manifold, causing the respective first control valve 13 to open. As described above, the opening of first control valve 13 will open both first and second water supply valves 15 and 19, and will deliver water to bottom jet 5 and rim 3. After 1 to 2 seconds following a release of push button 32, water flowing through orifice 49 will re-pressurize line 51, cause first control valve 13 to close, and will stop the flow of water to both bottom jet 5 and rim 3.

The operation of second flush control 22 is similar. With a depression of push button 32 third control valve 23 will open. The release of push button 32 will cause third control valve 23 to close in approximately 1 to 2 seconds. The primary difference in the operation of second flush control 22 is that water is not delivered to bottom jet 5 through operation of second flush control 22, as it is when first flush control 11 is operated.

The operation of each of first and second flush controls 11 and 22 as described will also have the effect of delivering cleaning solution from tank 9 to rim 3 as described above.

From a thorough understanding of the invention, it will be appreciated there is provided a water control system for a tankless toilet that can provide a supply of pressurized water to the toilet's bottom jet to result in a flushing action and/or supply a volume of water to the toilet's rim. The control system further enables the ability to provide a volume of cleaning solution to the rim with the delivery of water thereto. The system allows for a "regular" flush or a "smaller" volume flush, depending upon the requirements and the nature of the waste to be evacuated from the toilet bowl. The system is configured such that the second control valve 14, and the first and second water supply valves may be housed together in a central housing 10. In an embodiment, central housing 10 may further include first diaphragm pump 24 and second diaphragm pump 31, permitting the control system to be configured in a relatively compact housing that can be inconspicuously mounted in a wall, on the side of the toilet, or other such desired location. The hydraulically closed and spring or biased opened valves, together with the spring return magnetic actuators that comprise the first and second flush controls, enable the entire system to be operated without the use of electricity or any external source of power or mode of operation, aside from the residential or commercial source of water pressure.

The embodiments of the present application described above are intended to be examples only. Those of skill in the art may effect alterations, modifications and variations to the particular embodiments without departing from the intended scope of the present application. For example, while in some cases points of reference have referred to "up" or "down" positions. It will be appreciated that other relative positions are possible, depending on the orientation of the component in question. Further, features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole.

I claim:

1. A water control system for a tankless toilet, the water control system comprising:

a first flush control operating a first control valve, a second control valve, and a first water supply valve, each of the first control valve, the second control valve, and the first water supply valve having an open and a closed configuration, the first control valve moved between its open and its closed configuration by operation of the first flush control, the second control valve and the first water supply valve moved between their open and their closed configurations by operation of the first control valve, when the first control valve is in its closed configuration pressurized water from a pressurized source is applied to the second control valve and the first water supply valve maintaining them in their closed configurations, when the first control valve is in its open configuration the pressure of water from the pressurized source applied to the second control valve and the first water supply valve is reduced causing the second control valve and the first water supply valve to move to their open configurations, when the first water supply valve is in its closed configuration pressurized water from the pressurized source is prevented from being delivered to a bowl of the toilet, when in its open configuration the first water supply valve permitting the delivery of pressurized water from the pressurized source to a bottom jet of the toilet bowl.

2. The water control system as claimed in claim 1, wherein the second control valve is operatively associated with a second water supply valve having an open and a closed configuration, the second water supply valve moved between its open and its closed configuration through operation of the second control valve, when in its open configuration the second water supply valve permitting the delivery of pressurized water from the pressurized source to a rim input of the toilet bowl, when in its closed configuration the second water supply valve preventing the delivery of pressured water from the pressurized source to the rim input.

3. The water control system as claimed in claim 2, wherein movement of the first control valve from its closed to its open configuration causes the first and second water supply valves to move from their closed to their open configurations permitting water from the pressurized source to be delivered to both the bottom jet and the rim input of the toilet bowl.

4. The water control system as claimed in claim 1, comprising a second flush control operating a third control valve having an open and a closed configuration, when in its open configuration the third control valve causing a second water supply valve to move from a closed to an open configuration to permit water from the pressurized source to be delivered to a rim input of the toilet bowl.

5. The water control system as claimed in claim 2, comprising a second flush control operating a third control valve having an open and a closed configuration, when in its open configuration the third control valve causing the second water supply valve to move from its closed to its open configuration to permit water from the pressurized source to be delivered to the rim input of the toilet bowl.

6. The water control system as claimed in claim 1 comprising a first diaphragm pump operatively associated with the first control valve and having a first and a second diaphragm position, when the first control valve is in its closed configuration the first diaphragm pump is in its first diaphragm position, when the first control valve moves from its closed to its open configuration the first diaphragm pump is moved to its second diaphragm position thereby transferring water from its first diaphragm position into its second diaphragm position, when the first control valve moves from its open to its closed configuration the first diaphragm pump moves from its second diaphragm position to its first diaphragm position thereby forcing cleaning solution from a cleaning solution tank to be delivered to a rim of the toilet bowl.

7. The water control system as claimed in claim 6 comprising a second diaphragm pump operatively associated with the second control valve and having a first and second diaphragm position, when the second control valve is in its closed configuration the second diaphragm pump is in its first diaphragm position, when the second control valve moves from its close to its open configuration the second diaphragm pump is moved from its first to its second diaphragm position thereby transferring water from its first diaphragm position into its second diaphragm position, when the second control valve moves from its open to its closed configuration the second diaphragm pump moves from its second diaphragm position to its first diaphragm position thereby forcing cleaning solution from the cleaning solution tank to be delivered to the rim of the toilet bowl.

8. The water control system as claimed in claim 4 wherein the first water supply valve, the second control valve, and the second water supply valve are housed together in a central housing.

9. The water control system as claimed in claim 7 wherein the first diaphragm pump and the second diaphragm pump are housed in a central housing.

10. The water control system as claimed in claim 8 wherein the first and second diaphragm pumps are housed in the central housing.

11. The water control system as claimed in claim 4 wherein the first and second flush controls are spring return magnetic actuators.

12. The water control system as claimed in claim 5 wherein the second control valve, the first water supply valve, and the second water supply valve are each selected from the group consisting of a hydraulically closed spring valve and a biased opening valve.

13. A water control system for a tankless toilet, the water control system comprising:

a first flush control, a first control valve, a second control valve, a second flush control operating a third control valve, and a first water supply valve, each of the first control valve, the second control valve, and the first water supply valve having an open and a closed configuration, the first control valve moved between its open and its closed configuration by operation of the first flush control, the second control valve and the first water supply valve moved between their open and their closed configurations by operation of the first control valve, when the first control valve is in its closed configuration pressurized water from a pressurized source is applied to the second control valve and the first water supply valve maintaining them in their closed configurations, when the first control valve is in its open configuration the pressure of water from the pressurized source applied to the second control valve and the first water supply valve is reduced causing the second control valve and the first water supply valve to move to their open configurations, when the first water supply valve is in its closed configuration pressurized water from the pressurized source is prevented from being delivered to a bowl of the toilet, when in its open configuration the first water supply valve permitting the delivery of pressurized water from the pressurized source to a bottom jet of the toilet bowl, wherein the second control valve is operatively associated with a second water supply valve having an open and a closed configuration, the second water supply valve moved between its open and its closed configuration through operation of the second control valve, when in its open configuration the second water supply valve permitting the delivery of pressurized water from the pressurized source to a rim input of the toilet bowl, when in its closed configuration the second water supply valve preventing the delivery of pressured water from the pressurized source to the rim input, wherein the second flush control operates a third control valve having an open and a closed configuration, when in its open configuration the third control valve causing the second water supply valve to move from its closed to its open configuration to permit water from the pressurized source to be delivered to a rim input of the toilet bowl.

14. The water control system of claim 13 comprising a first diaphragm pump operatively associated with the first control valve and having a first and second diaphragm position, when the first control valve is in its closed configuration the first diaphragm pump is in its first diaphragm position, when the first control valve moves from its closed to its open configuration the first diaphragm pump is moved to its second diaphragm position thereby transferring water from its first diaphragm position into its second diaphragm position, when the first control valve moves from its open to its closed configuration the first diaphragm pump moves from its second diaphragm position to its first diaphragm position thereby forcing cleaning solution from a cleaning solution tank to be delivered to a rim of the toilet bowl.

15. The water control system as claimed in claim 14 comprising a second diaphragm pump operatively associated with the second control valve and having a first and second diaphragm position, when the second control valve is in its closed configuration the second diaphragm pump is in its first diaphragm position, when the second control valve moves from its closed to its open configuration the second diaphragm pump is moved from its first to its second diaphragm position thereby transferring water from its first diaphragm position into its second diaphragm position, when the second control valve moves from its open to its closed configuration the second diaphragm pump moves from its second diaphragm position to its first diaphragm position thereby forcing cleaning solution from the cleaning solution tank to be delivered to the rim of the toilet bowl.

16. The water control system as claimed in claim 15 wherein the first water supply valve, the second control valve, and the second water supply valve are housed in a central housing.

17. The water control system as claimed in claim 16 wherein the first diaphragm pump and the second diaphragm pump are housed in the central housing.

* * * * *